United States Patent [19]

Griffith

[11] 4,037,536

[45] July 26, 1977

[54] ENCLOSURE FOR EXPLOSIVE MATERIAL

[75] Inventor: George L. Griffith, Coopersburg, Pa.

[73] Assignee: IMC Chemical Group, Inc., Terre Haute, Ind.

[21] Appl. No.: 611,593

[22] Filed: Sept. 8, 1975

[51] Int. Cl.[2] ..... F42B 3/00

[52] U.S. Cl. ..... 102/20; 102/24 R

[58] Field of Search ..... 102/24 HC, 24 R, 20

[56] References Cited

U.S. PATENT DOCUMENTS

| | | | |
|---|---|---|---|
| 2,687,093 | 8/1954 | Botts | 102/24 R |
| 2,887,953 | 5/1959 | Mager | 102/24 R |
| 3,374,736 | 3/1968 | Dow et al. | 102/24 R |
| 3,376,816 | 4/1968 | Foster et al. | 102/24 R |
| 3,420,173 | 1/1969 | Slawinski et al. | 102/24 R |
| 3,517,616 | 6/1970 | Martin | 102/24 R |
| 3,789,760 | 2/1974 | Griffith | 102/24 HC |
| 3,926,119 | 12/1975 | Hurst et al. | 102/24 R |

*Primary Examiner*—David H. Brown

*Attorney, Agent, or Firm*—E. A. Figg; Howard E. Post

[57] ABSTRACT

An improved enclosure for explosive material of the type having an enclosed sealed, cylindrical container, and a sleeve in encircling engagement with the container, and cooperating with the sidewall of the container to define at least one recess adapted to receive a detonator, wherein the improvement comprises a depression in the sidewall of the container, and a resilient protrusion of the inner surface of the sleeve, engaging said sidewall depression, thereby hindering the sleeve from slipping off the container.

1 Claim, 10 Drawing Figures

FIG. 1
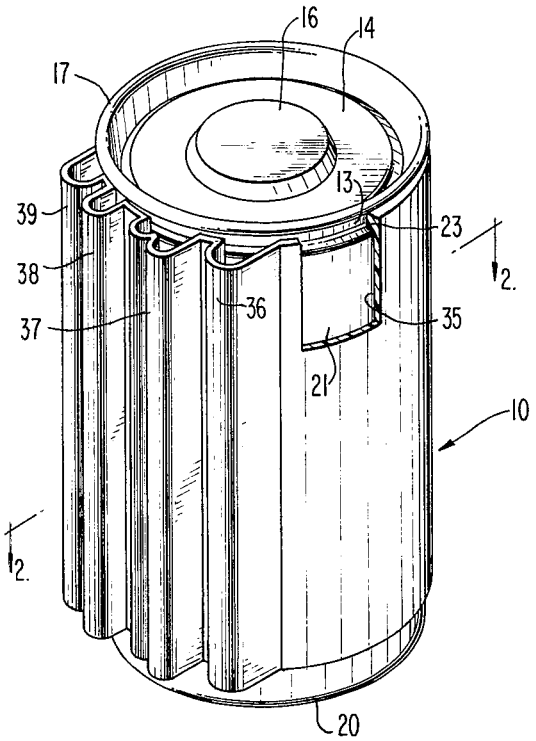
FIG. 2
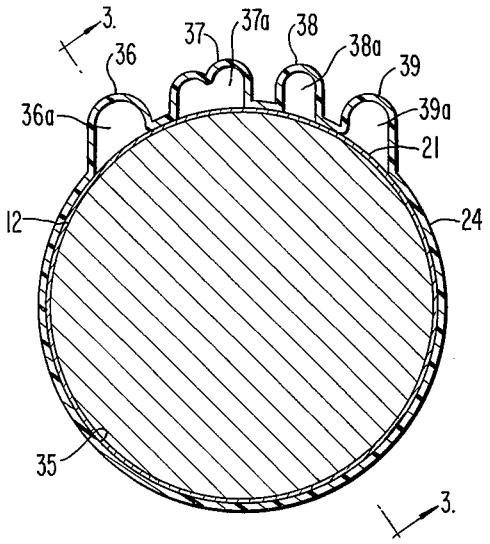
FIG. 3
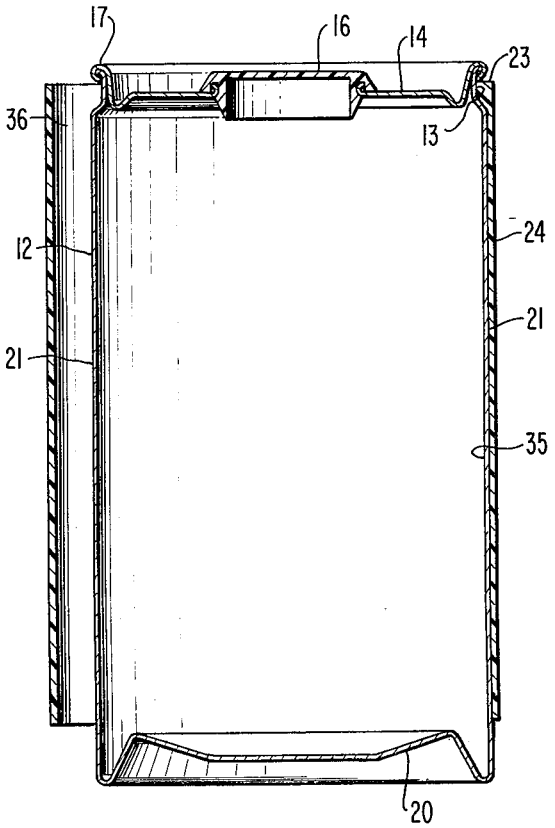
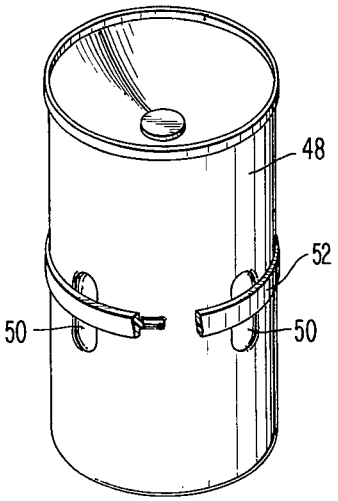
FIG. 10

FIG. 4
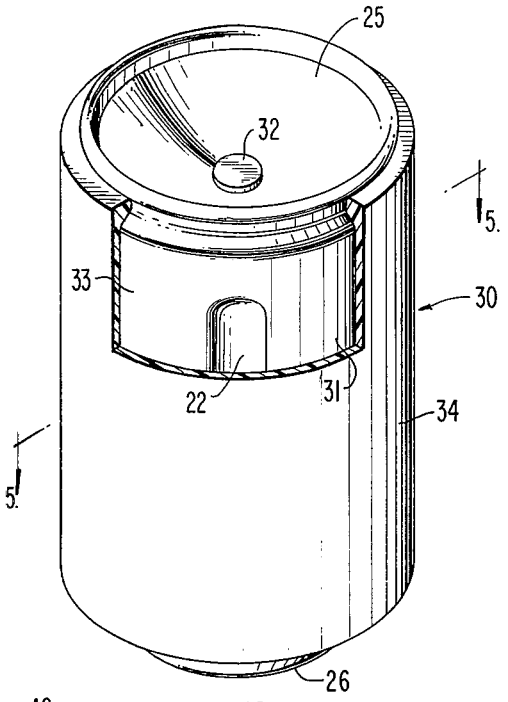
FIG. 5
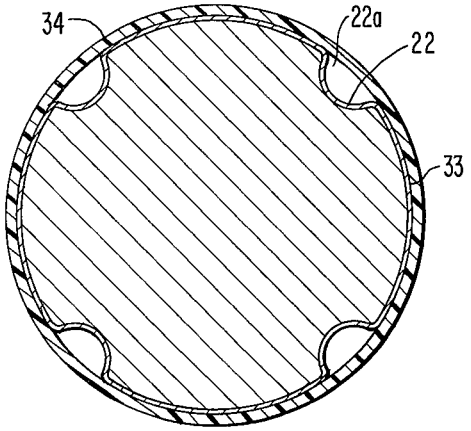
FIG. 6
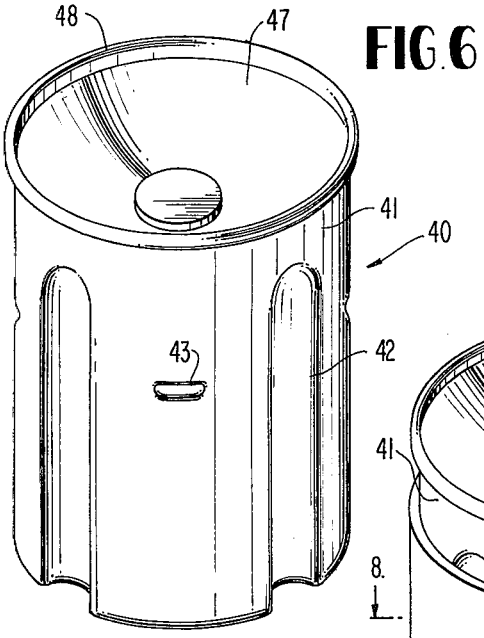
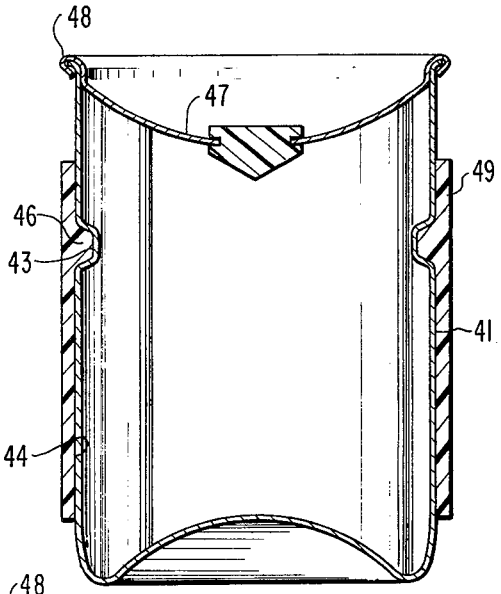
FIG. 9
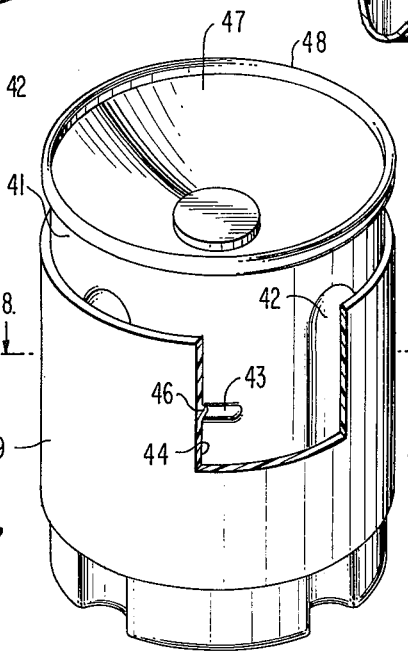
FIG. 7
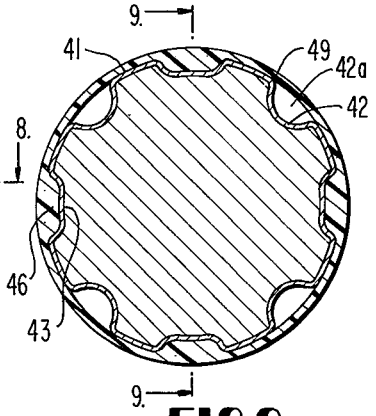
FIG. 8

ENCLOSURE FOR EXPLOSIVE MATERIAL

BACKGROUND OF THE INVENTION

This invention generally relates to an improved container for explosive material. More particularly, the invention relates to an improvement in an explosive primer or booster of the general type including a sealed, cylindrical container for explosive material and a sleeve, encirclingly engaging the container, for holding detonators in close proximity to the container and its explosive contents. The purpose of the improvement is to hinder the sleeve from slipping off the container during normal usage.

Explosive primers or boosters to which this invention may apply are described by G. L. Griffith in U.S. Pat. No. 3,789,760 which issued Feb. 5, 1974, incorporated herein by reference. Such primers generally function well and possess significant advantages over other devices. It has been found that occasionally, however, the sleeve of such primers, which, heretofore, was held on only by friction, slips off the container during normal usage, thus allowing the detonators to fall away from the container. Because of the difference between the coefficients of thermal expansion of the container and its contents and the sleeve, this problem usually occurs when the primer is subjected to a sudden decrease in temperature, such as when it is placed in a borehole or other location where an explosive charge is being set. The container shrinks more rapidly than the sleeve, thus allowing the sleeve to slip off. The result of the detonators becoming detached from the container is usually a misfire. A misfire requires that a new primer be inserted into the explosive charge, and detonation attempted again, thus requiring the loss of time and materials and the creation of a potentially hazardous situation.

Accordingly, a need exists for a means for hindering the sleeve of such primers or boosters from slipping off the container, and allowing the detonators to become removed from the explosive material.

SUMMARY OF THE INVENTION

An object of the invention is to provide an improved enclosure for explosive material. Another object is to provide an improvement in an explosive primer or booster of the general type including a sealed cylindrical container for explosive material and a sleeve, encirclingly engaging the container, for holding detonators in close proximity to the container and its explosive contents; the purpose of such improvement being to hinder the sleeve from slipping off the container during normal usage.

In accordance with the invention, there is disclosed an improved enclosure for explosive material of the type having a cylindrical container including an enclosed lower end, a sidewall sealingly secured to said lower end, a cover adapted to be sealingly secured to said sidewall with a seam to form an enclosed, sealed container, and a sleeve in encircling engagement with the container, said sleeve and said sidewall including means cooperating to define at least one recess adapted to receive a detonator, wherein the improvement comprises:

a depression in said sidewall, and a resilient protrusion of the inner surface of said sleeve engaging said sidewall depression, thereby hindering said sleeve form slipping off said sidewall.

BRIEF DESCRIPTION OF THE DRAWINGS

Other objects and advantages of the invention will become apparent from the disclosure herein and upon reference to the drawings, in which:

FIG. 1 is a perspective view of an improved enclosure in accordance with the present invention, with a portion of the sleeve shown in broken section to illustrate the details of the improvement therein;

FIG. 2 is a transverse cross-sectional view of the improved enclosure of FIG. 1, taken along line 2—2 of FIG. 1;

FIG. 3 is a longitudinal cross-sectional view of the improved enclosure of FIG. 1 taken along line 3—3 of FIG. 2;

FIG. 4 is a perspective view of another embodiment of the improved enclosure of the present invention, with a portion of the sleeve shown in broken section to illustrate the details of the improvement therein;

FIG. 5 is a transverse cross-sectional view of the improved enclosure of FIG. 4 taken along line 5—5 of FIG. 4;

FIG. 6 is a perspective view of the container of an improved enclosure, showing another embodiment of the present invention;

FIG. 7 is a perspective view of an improved enclosure employing the container of FIG. 6, with a portion of the sleeve shown in broken section to illustrate the details of the improvement therein;

FIG. 8 is a transverse cross-sectional view of the improved enclosure of FIG. 7 taken along line 8—8 of FIG. 7;

FIG. 9 is a longitudinal cross-sectional view of the improved enclosure of FIG. 7 taken along line 9—9 of FIG. 8; and FIG. 10 is a perspective view of yet another embodiment of the improved enclosure of the present invention:

While the invention will be described in connection with certain preferred embodiments, it will be understood that it is not intended to be limited to those embodiments. On the contrary, it is intended to cover all alternatives, modifications and equivalents as may be included within the spirit and scope of the invention as defined by the appended claims.

DETAILED DESCRIPTION OF THE INVENTION

FIGS. 1 through 3 depict a specific embodiment of the present invention. In FIG. 1 is shown an explosive booster 10. The booster comprises a container 12 for explosive material in the form of a can, e.g. a metal can such as one made of aluminum. Container 12 has a sidewall 21, an enclosed lower end 20, and a cover 14, sealingly secured to the sidewall. Sidewall 21 and enclosed lower end 20 may be formed in one piece, for example by an extrusion process, or, alternatively, the lower end may be formed separately and sealed onto the sidewall. Preferably, cover 14 includes, in substantially its center, an opening with a cap 16 inserted therein to provide a liquid-tight seal. Cap 16 therefore provides a safety valve, so if, for example, container 12 is hit by a projectile, or is in a fire, causing pressure within the container to increase, cap 16 pops off to prevent explosion.

As shown in FIGS. 1 through 3, sleeve 24 fits over container 12 in encircling engagement therewith. Sleeve 24 has an inner surface 35 which is provided with furrows 36, 37, 38 and 39 which cooperate with sidewall 21 of container 12 to define recesses 36*a*, 37*a*, 38*a* and 39*a*. Furrows 36, 37, 38 and 39 are, thus, formed integrally in inner surface 35, and may extend the entire length of sleeve 24 to form the recesses 36*a*, 37*a*, 38*a* and 39*a* which accept a conventional blasting cap or a length of detonating cord, or may extend the partial length of sleeve 24, e.g. from the bottom of sleeve 24 to a point below the top to accept a blasting cap. The recesses may be of the same or different size and shape. In the preferred embodiment illustrated the recesses are of different sizes. The smaller recess 38*a* is typically of a size and shape to permit a snug insertion of an electric blasting cap into the recess and maintain such electric blasting cap in contact with the sidewall 21. The larger recesses 36*a* and 39*a* are typically of a size and shape to accommodate detonating cord in slidable engagement, so that the explosive booster 10 may slide along detonating cord as conventionally used as a "down line" when loading a borehole. Such use is well known in the blasting field.

FIGS. 1 through 3 also depict an improvement in the explosive booster 10. Sidewall 21 of container 12 is provided with a depression 13 at a point below the seam 17 formed by the junction of sidewall 21 with cover 14. Depression 13 extends completely around the circumference of sidewall 21 with seam 17 constituting the upper boundary thereof. Inner surface 35 of sleeve 24 is provided with a resilient protrusion 23 which corresponds in shape with sidewall depression 13. Protrusion 23 is formed at the top of sleeve 24 and extends around the inner circumference thereof, with interruptions at furrows 36, 37, 38 and 39. The engagement of protrusion 23 in depression 13 hinders sleeve 24 from slipping off container 12 during normal usage of the explosive booster, such as during normal handling and especially when sliding the booster 10 down a down line in a typical blasting operation.

FIGS. 4 and 5 depict another embodiment of the improved booster of this invention, with the principal difference from the device shown in FIGS. 1 through 3 being that rather than furrows 36 in the inner surface 35 of sleeve 24, one or more indentations 22 of container sidewall 31 are employed to provide at least one recess 22*a* to receive a detonator. As shown in FIG. 5, indentations 22 may be substantially equally spaced, angularly about the sidewall to provide a shaped charge effect upon detonation of the booster.

FIGS. 6 through 9 depict yet another embodiment of the improved enclosure of the present invention, which employs a variation of the improvement therein. In FIG. 6 is shown a container 40 having substantially the same features of the container depicted in the booster of FIGS. 4 and 5, with the principal difference being in the shape and position of the container sidewall depression. One or more depressions 43 are formed in sidewall 41 between the lower end and the upper end of sidewall 41, extending partially around the circumference of said sidewall. Inner surface 44 of sleeve 49 is provided with one or more resilient protrusions 46 corresponding in shape and position with sidewall depressions 43. Sleeve inner surface protrusions 46 engage sidewall depressions 43 to hinder sleeve 49 from slipping off container 40 during normal usage. The employment of such a configuration allows the use of a sleeve shorter than recesses 42, which, as depicted in FIG. 10, may even take the form of a narrow band 52; thus allowing greater flexibility in the selection of the detonators used to initiate the device. Electric blasting caps are conventionally used as the detonators and such caps are commercially supplied in several sizes and are of generally cylindrical shape.

In the improved enclosures described herein, the outer surface of the lower end of the container and the other surface of the cover may have concave configurations. Such configurations cooperate to provide a shaped charge effect to the explosion which results from detonation of the booster.

Thus it is apparent that there has been provided, in accordance with the invention, an improved enclosure for explosive material that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, the invention is intended to embrace all such alternatives, modifications, and variations as fall within the spirit and broad scope of the appended claims.

I claim:

1. An improved enclosure for explosive material of the type having a cylindrical container including an enclosed lower end, a sidewall sealingly secured to said lower end, a cover adapted to be sealingly secured to said sidewall with a seam to form an enclosed, sealed container, and a sleeve in encircling engagement with the container extending substantially the entire length of said sidewall, said sleeve and said sidewall including means cooperating to define at least one recess adapted to receive a detonator, and maintain said detonator in contact with said sidewall along substantially the entire length of said sidewall, wherein the improvement comprises:

a depression in the upper end of said sidewall below the seam of said sidewall with said cover, extending around the circumference of said sidewall, with said seam constituting the upper boundary of said depression; and a resilient protrusion of the inner surface of said sleeve at the upper end of said sleeve, having a shape corresponding to that of said sidewall depression, and extending at least partially around the circumference of the inner surface of said sleeve, said protrusion engaging said sidewall depression, thereby enabling said sleeve to be slid onto said sidewall without axial rotation and hindering said sleeve from slipping off said sidewall.

* * * * *